US008801235B2

(12) United States Patent
Yurich

(10) Patent No.: US 8,801,235 B2
(45) Date of Patent: Aug. 12, 2014

(54) LIGHTING ASSEMBLY

(75) Inventor: Gary D. Yurich, Royal Oak, MI (US)

(73) Assignee: Best Lights, Troy, MI (US)

( * ) Notice: Subject to any disclaimer, the term of this patent is extended or adjusted under 35 U.S.C. 154(b) by 309 days.

(21) Appl. No.: 13/434,530

(22) Filed: Mar. 29, 2012

(65) Prior Publication Data

US 2012/0182741 A1 Jul. 19, 2012

Related U.S. Application Data

(63) Continuation-in-part of application No. 12/684,524, filed on Jan. 8, 2010, now Pat. No. 8,641,239.

(51) Int. Cl.
*F21V 7/09* (2006.01)
*F21V 7/00* (2006.01)

(52) U.S. Cl.
USPC ..... 362/346; 362/341; 362/297; 362/296.09

(58) Field of Classification Search
CPC ..... F21V 7/04; F21V 7/09; F21V 7/0025; F21V 7/0008; F21V 7/00; F21V 7/06; F21V 7/048; F21V 13/04; F21S 48/1388; F21S 48/23; F21S 48/137; F21S 48/1376; F21S 48/1358; H01L 33/60; H01L 33/58
USPC ..... 362/296.01–310, 341–350
See application file for complete search history.

(56) References Cited

U.S. PATENT DOCUMENTS 1,186,165 A 6/1916 Benjamin
3,329,812 A 7/1967 Harling
3,643,088 A 2/1972 Osteen
3,662,165 A 5/1972 Osteen et al.
3,900,727 A 8/1975 Hutz
4,363,086 A 12/1982 Fletcher
4,403,277 A 9/1983 Eargle, Jr. et al.
4,453,203 A 6/1984 Pate
4,864,476 A 9/1989 Lemons et al.
5,287,259 A * 2/1994 Lautzenheiser ..... 362/341
5,355,290 A 10/1994 Tickner (Continued)

OTHER PUBLICATIONS

Ndoor Courts of America, Elite Lighting System, http://www.icasbs.com/images/Elite%20Lighting%20Spec%20Sheet.pdf (Retrieved on or about Jan. 28, 2009), 2 pages.

(Continued)

*Primary Examiner* — Karabi Guharay
*Assistant Examiner* — Nathaniel Lee
(74) *Attorney, Agent, or Firm* — Howard & Howard Attorneys PLLC

(57) ABSTRACT

A lighting assembly for illuminating an area is disclosed. The assembly includes a housing and at least one light socket disposed within the housing. The light socket is configured to receive at least one light source to emit light therefrom. The assembly also includes a reflective body disposed about the at least one light socket for uniformly disbursing the light, emitted from the light source, out of the lighting assembly. The reflective body includes an array of first reflectors and an array of second reflectors, each disposed about a central axis. Adjacent first reflectors are in an obtuse angular relationship with one another. Each of the second reflectors include a left face and a right face. A reflex angle is formed between the left and right faces of the second reflectors. Each of the adjacent second reflectors are in an obtuse angular relationship with one another.

19 Claims, 14 Drawing Sheets

(56) References Cited

U.S. PATENT DOCUMENTS

| | | | | |
|---|---|---|---|---|
| 5,895,114 | A | 4/1999 | Thornton | |
| 5,927,843 | A | 7/1999 | Haugaard et al. | |
| 5,975,723 | A | 11/1999 | Daumueller | |
| 6,024,469 | A * | 2/2000 | Greif | 362/346 |
| 6,036,338 | A | 3/2000 | Gordin | |
| D431,316 | S | 9/2000 | Tickner | |
| 6,152,579 | A * | 11/2000 | Reed et al. | 362/320 |
| 6,382,803 | B1 | 5/2002 | Arumugasaamy | |
| 6,390,649 | B1 | 5/2002 | Tang | |
| 6,464,378 | B1 | 10/2002 | Reed et al. | |
| 6,595,662 | B2 | 7/2003 | Wardenburg | |
| 6,601,975 | B1 | 8/2003 | Haugaard et al. | |
| 6,703,799 | B2 | 3/2004 | Summerford et al. | |
| 6,814,480 | B2 | 11/2004 | Amano | |
| 6,837,900 | B2 | 1/2005 | Ullrich et al. | |
| 7,025,476 | B2 | 4/2006 | Leadford | |
| 7,244,050 | B2 | 7/2007 | Summerford et al. | |
| 7,350,940 | B2 | 4/2008 | Haugaard et al. | |
| 7,445,362 | B2 | 11/2008 | Compton et al. | |
| 7,445,363 | B2 | 11/2008 | Vanden Eynden | |
| 8,096,670 | B2 | 1/2012 | Trott et al. | |
| 2003/0035299 | A1 | 2/2003 | Amano | |
| 2007/0070633 | A1 | 3/2007 | Eynden | |
| 2008/0137347 | A1 | 6/2008 | Trott et al. | |
| 2010/0214789 | A1 | 8/2010 | Hawkes et al. | |
| 2011/0169412 | A1 | 7/2011 | Yurich | |

OTHER PUBLICATIONS

Sports Interiors, Inc., Metal Halide Sun Series, Indirect Vertical Lamp Pendant, http://www/silighting.com/fixture.htm (Retrieved on or about Jan. 28, 2009), 2 pages.

* cited by examiner

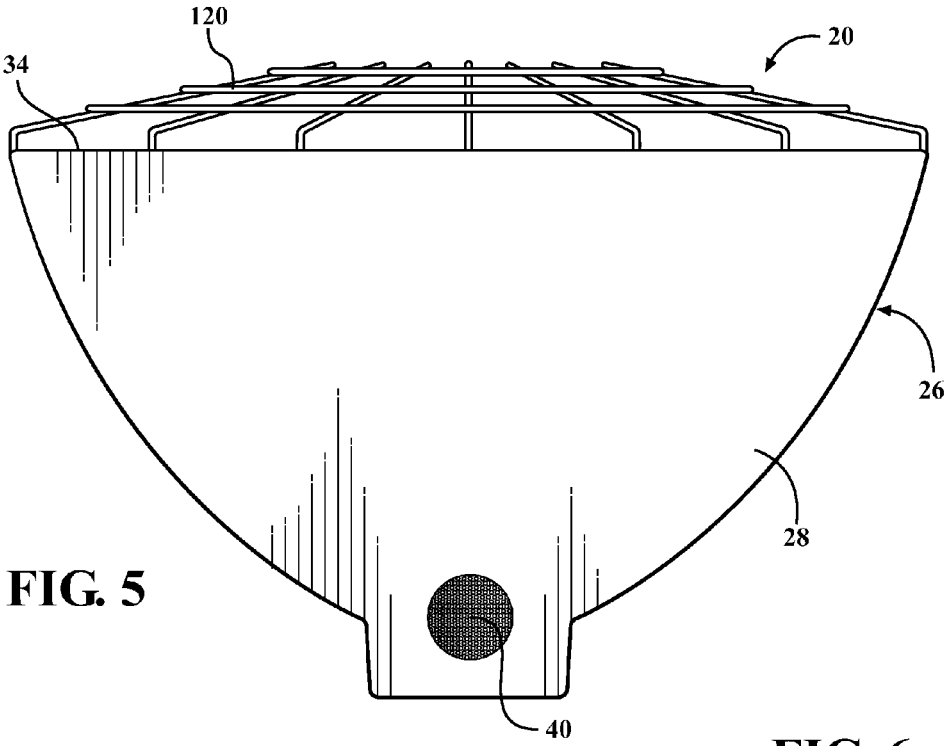
FIG. 5
FIG. 6
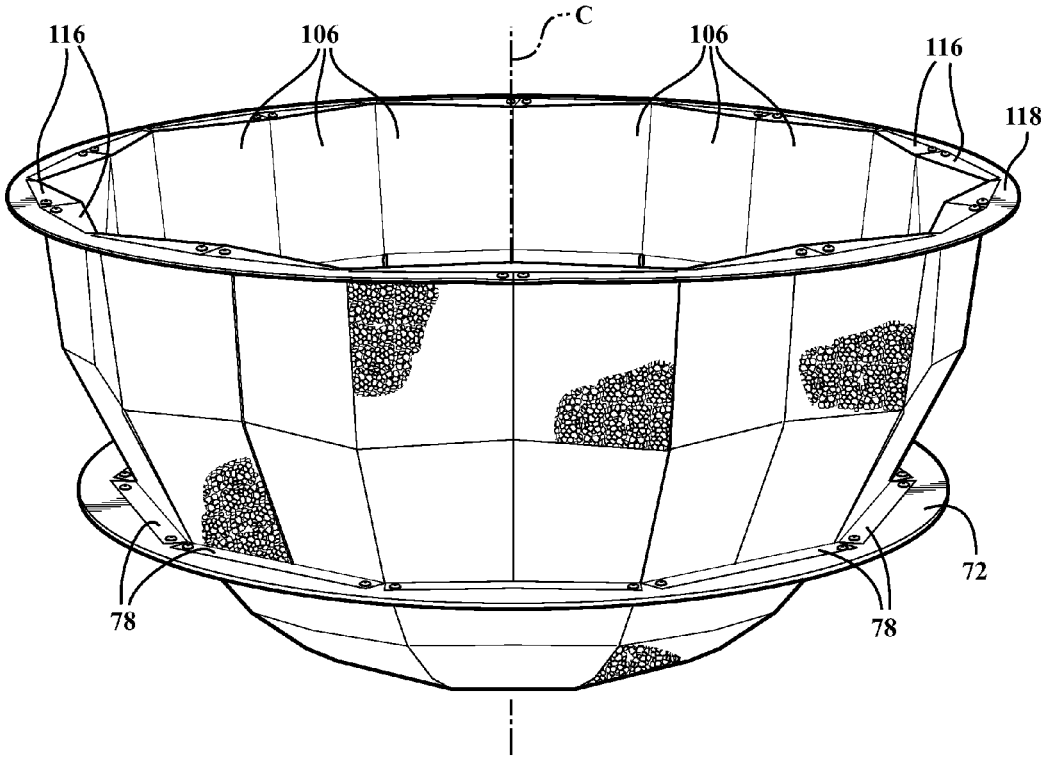

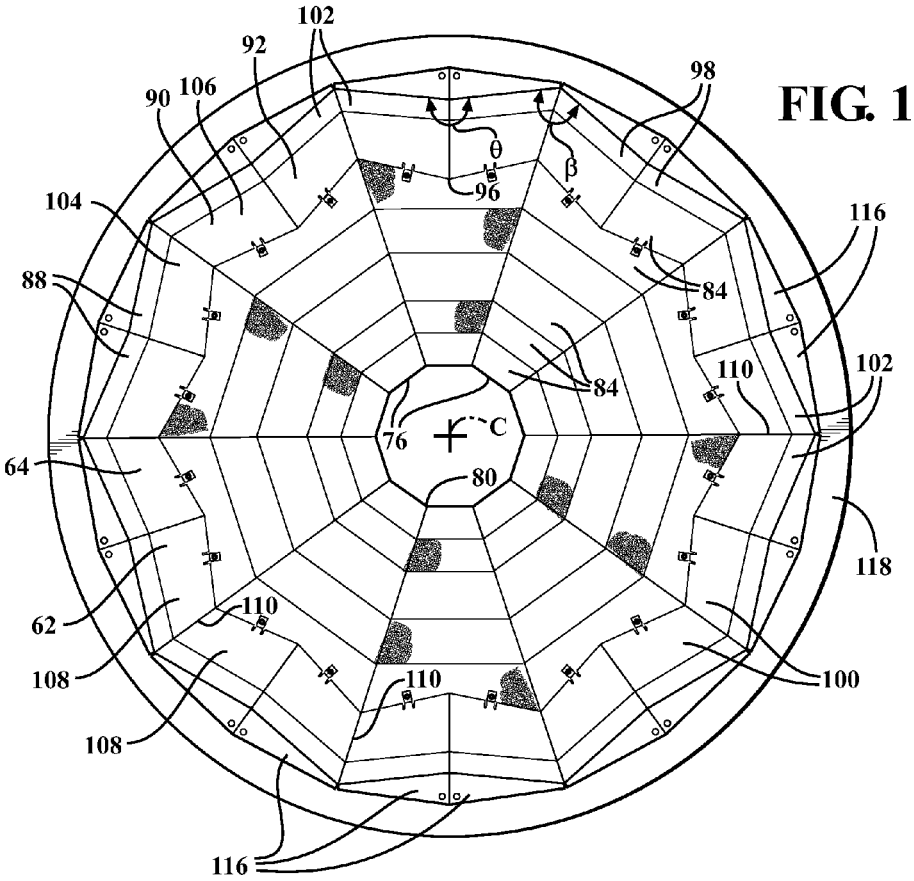
FIG. 12
FIG. 13
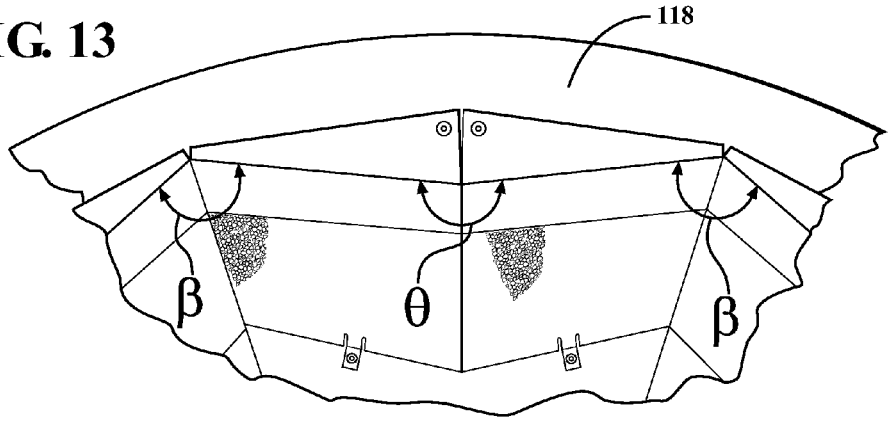

LIGHTING ASSEMBLY

RELATED APPLICATIONS

This application is a continuation in part application of U.S. patent application Ser. No. 12/684,524 for a REFLECTOR FOR A LIGHTING ASSEMBLY, filed on Jan. 8, 2010, which is hereby incorporated by reference in its entirety.

FIELD OF THE INVENTION

The present invention generally relates to a lighting assembly. More specifically, the present invention relates to a reflective body for dispersing light out of the lighting assembly.

BACKGROUND

Various lighting assemblies utilizing reflectors are well known in the prior art. Many on the lighting assemblies of the prior art include reflectors in an attempt to optimize the amount of light output. One such assembly, used for industrial lighting, utilizes a dome-shaped reflector formed of vertically oriented faces arranged around an axis. Each of the faces extend from the top to the bottom of the dome and are symmetrically arranged side-by-side for defining a plurality of vertically oriented ridges and grooves to provide overlapping areas of light to the area below the light assembly. Additionally, each of the faces have a convex configuration with respect to the lamp.

Another prior art patent, for use with outdoor field lighting discloses a reflector having a dome-shaped base structure with a plurality of reflective panels flexed to conform to the dome-shaped of the base structure and fastened therein, about a lamp. Each of the sections defines a face having a surface treatment, such as a hammer-toned finish or a corrugated finish.

Other prior art patents disclose lighting assemblies having a housing including a reflector disposed therein. An electrical system, including for regulating electricity, is coupled to the housing or is mounted to an area near the lighting system. These types of assemblies require extensive wiring to be done by a professional such as an electrician to properly connect the ballast to the electricity source and to the lighting assembly. Typically there are multiple lights required to light the area, therefore installation can be very time consuming and the associated costs can be substantial.

These patents fail to disclose a housing that is configured to accept all of the electrical components within the housing. As stated above, the lighting assemblies disclosed in the prior art typically require an electrician or other type of specialized technician to properly install and wire these assemblies which can prove to be difficult near the ceiling, so far off the ground. Typically, lighting assemblies are less than 90% efficient, i.e. the assemblies emit less than 90% of the light output from the light source.

Although the prior art lighting assemblies attempt to improve efficiency of light output and extend the life of the lighting source within the assembly, there remains a need for a lighting assembly that is relatively simple and cost-effective to install and that efficiently disperses uniform lighting output.

SUMMARY OF THE INVENTION

The present invention provides a lighting assembly utilizing a reflective body for use with a light source to disperse light emitted from the light source. The reflective body includes a lower array of first reflectors arranged about a central axis. Each of the first reflectors form an obtuse angle with the next adjacent first reflector. The reflective body also includes an upper array of second reflectors arranged about the central axis. Each of said second reflectors include a left face and a right face. The upper array defines obtuse angles between next adjacent second reflectors. Additionally, reflex angles are defined between the left and right faces of the second reflectors. The combination of angles evenly disperses the light supplied from the light source to provide an improved glow. The lighting assembly of the present invention also provides for ease of installation. This is desirable because facilities typically require numerous assemblies. Additionally, the lighting assemblies of the present invention do not require specialized wiring to be done by the end user, i.e. saving the cost of an electrician or a specialized technician. The lighting assembly of the present invention need only be plugged into a standard electrical outlet. Further the lighting assembly of the present invention emits light more efficiently than the lighting assemblies currently known in the art.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 5 is an end view of the lighting assembly.

FIG. 6 is a perspective view of a reflective body of the lighting assembly.

FIG. 12 is a top view of the reflective body.

FIG. 13 is a fragmented enlarged top view of the reflective body.

DETAILED DESCRIPTION OF THE INVENTION

Referring to the Figures wherein like numerals indicate like or corresponding parts throughout the several views, a lighting assembly is generally shown at 20.

Figure 1:
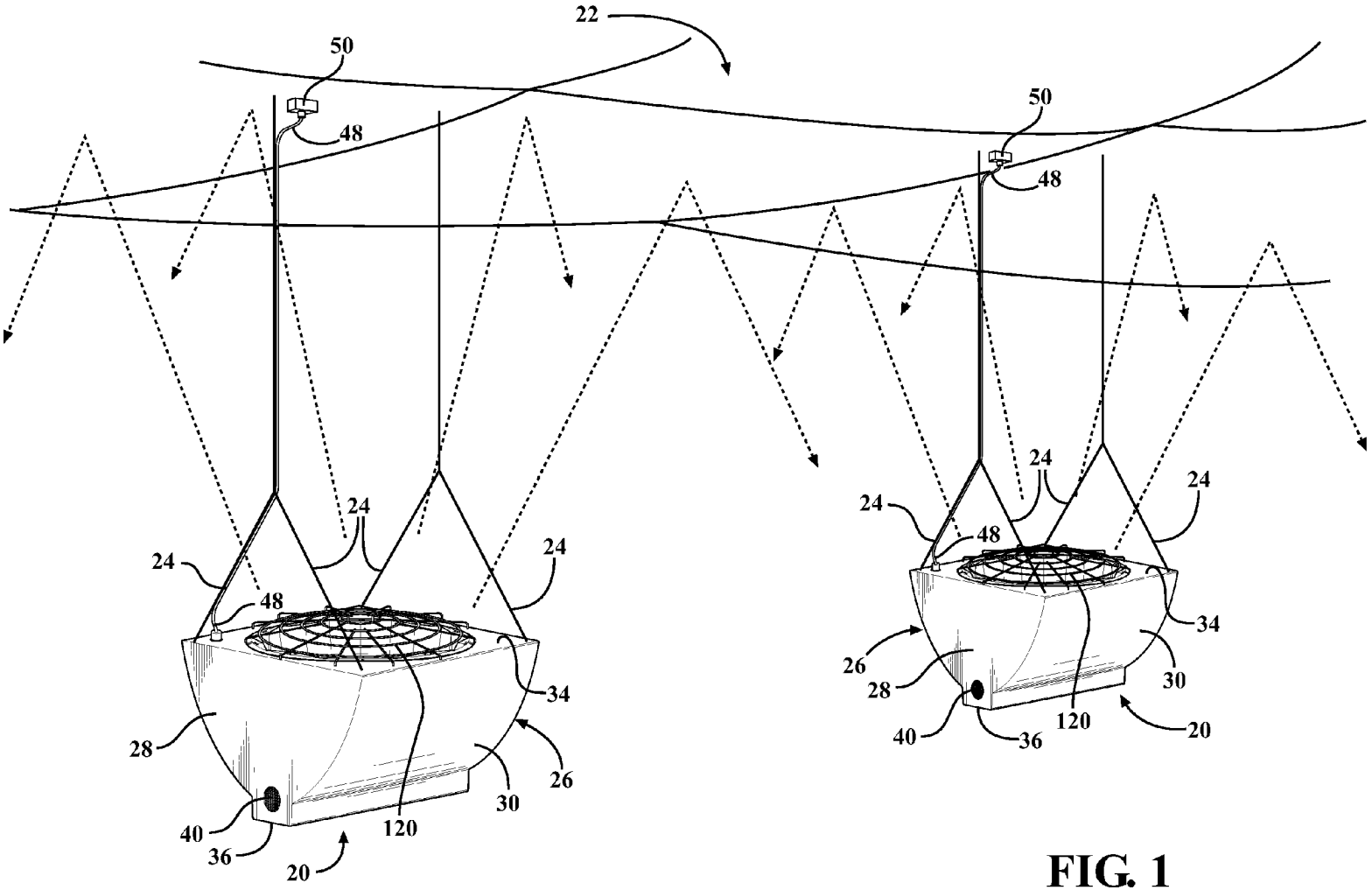
FIG. 1 is an environmental view of a plurality of lighting assemblies, suspended from a ceiling, of the present invention.
Figure 2:
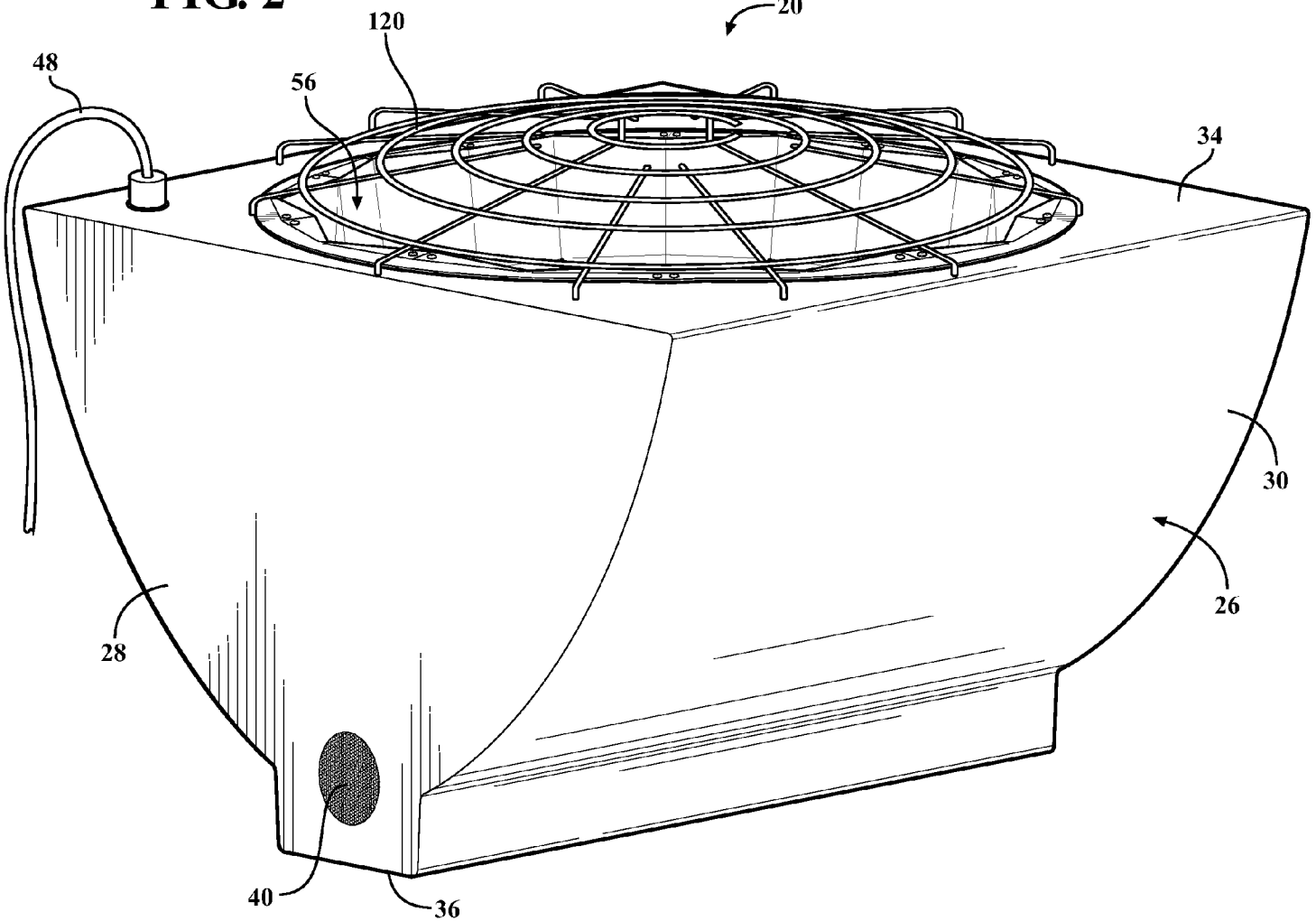
FIG. 2 is a perspective view of a lighting assembly of the present invention.

As best shown in FIG. 1, the lighting assembly 20 typically provides light for indoor facilities, such as sporting arenas, practice fields, and pool areas. The lighting assembly 20 is suspended from a ceiling 22 of the indoor facilities and illuminates the ceiling 22 thereby providing indirect light to an area below the lighting assembly 20. Hence, such assemblies are typically referred to as indirect-light assemblies. For illustrative purposes, light rays are shown with dashed lines in FIG. 1. The lighting assembly 20 is typically coupled to the ceiling 22 utilizing an attachment mechanism 24. The attachment mechanism 24 may comprise a plurality of cables 24 for suspending the lighting assembly 20 from the ceiling 22. However it should be appreciated that the attachment mechanism 24 may comprise any suitable method of coupling the lighting assembly 20 to the ceiling 22 without deviating from the scope of the subject invention.

Referring additionally to FIGS. 2-5, the lighting assembly 20 includes a housing 26. The housing 26 may comprise a pair of end walls 28 spaced from and substantially parallel to one another. The housing 26 may further include a pair of side walls 30 disposed between and substantially perpendicular to the end walls 28. The side walls 30 and the end walls 28 define a cavity 32 therebetween. A top wall 34 and a bottom wall 36 typically bound the end walls 28 and the side walls 30 and enclose the cavity 32. The top wall 34 defines an aperture 38 for allowing access into the cavity 32. The end walls 28 may define vents 40 for allowing air to enter into and exit out of the cavity 32 to ventilate the cavity 32.

Figure 3:
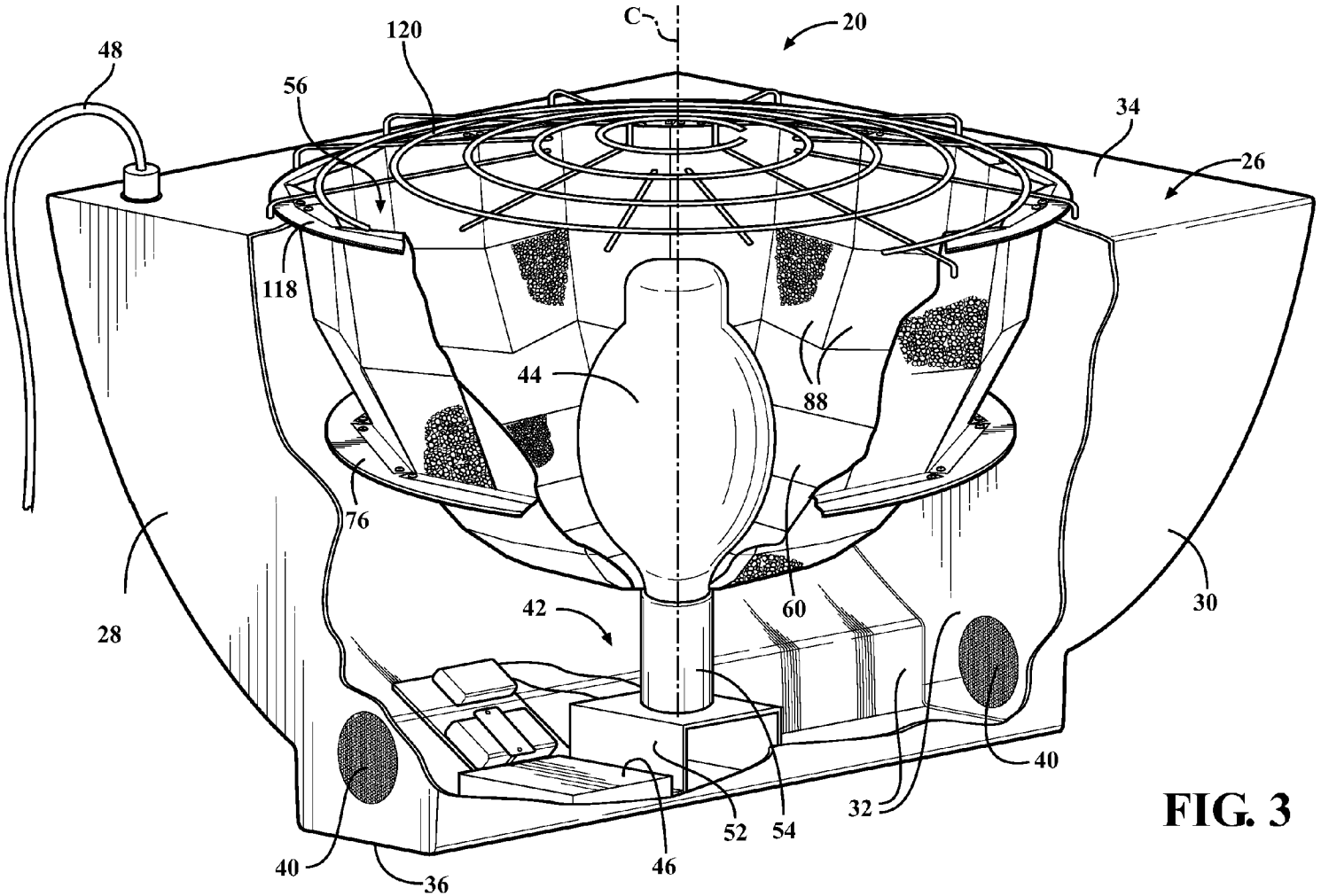
FIG. 3 is a partially cross-sectional perspective view of the lighting assembly.
Figure 4:
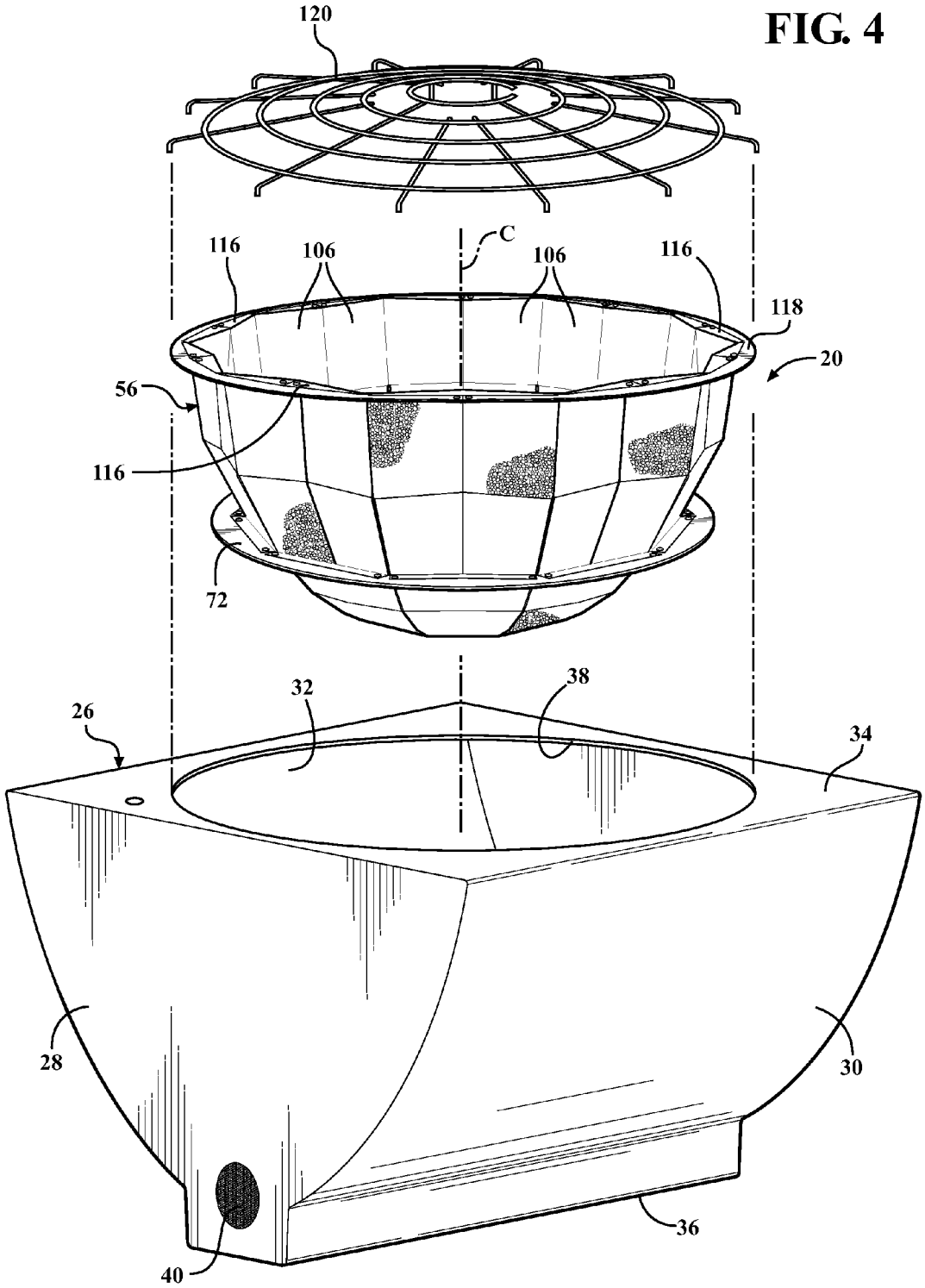
FIG. 4 is a partially exploded view of the lighting assembly.

As best shown in FIG. 3, the lighting assembly 20 includes an electrical system 42. The electrical system may be disposed within the cavity 32. The electrical system 42 includes a light source 44 and a ballast 46 coupled to the light source 44 for regulating electricity supplied to the light source 44. In one embodiment, the light source 44 is a metal halide lamp. For such types of lamps, a pulse-start ballast is typically used. It is to be appreciated that other types of light sources may be utilized without deviating from the scope of the subject invention, such as metal-halide, high-pressure sodium, mercury vapor, plasma light, light emitting diode (LED), gas-discharge lamp, or any other light source known in the art. Additionally, it should be appreciated that alternative types of ballasts or power supplies or AC/DC converters will be required based on the type of light source chosen and will not deviate from the subject invention.

A power cable 48 is disposed through the housing 26 for coupling the electrical system 42 to an electric power source 50 and supplying electricity thereto. Typically, the electric power source 50 is a standard electrical outlet, also known in the art as a receptacle. However, any appropriate electric power source 50 may be utilized. In some embodiments, the lighting assembly 20 may also be directly wired to the power source 50, generally known in the art as hard wired, without deviating from the scope of the present invention.

A lamp stand 52 is secured within the cavity 32 and includes a socket 54. The socket 54 accepts the light source 44 and electrically couples the light source 44 to the ballast 46. Generally, heat generated from the electrical system 42 may be dissipated through the aperture 38. The vents 40 draw in air to keep the light source 44 cool thereby extending the life of the light source 44. The lighting assembly 20 may further include a screen 120. The screen 120 is typically disposed over the reflective body 56 for protecting the light source 44, as well as the reflective body 56. The screen 120 may be further defined as a wire guard, a glass lens, or any other apparatus configured to cover the light source 44 and/or the reflective body 56, while allowing light to pass therethrough. With reference to FIGS. 1-5, the screen 120 may be coupled to the top wall 34 of the housing 26. Typically the screen 120 is removable from the housing 26 for allowing access to the light source 44. The screen 120 may be coupled to the top wall 34 utilizing any appropriate method. As an example, the top wall 34 may define a plurality of holes and the screen 120 may be configured to mate with the holes in the top wall 34 for securing the screen 120 thereon. Alternatively, the screen 120 may be configured to fit within the aperture 38 defined by the top wall 34 such that the screen 120 is retained over the reflective body 56 through a tension created between the housing 26 and the screen 120. In other alternatives the screen 120 may be coupled to the top wall 34 utilizing fasteners such as clips, clasps, latches, or any other appropriate fastener.

The lighting assembly 20 further includes a reflective body 56 disposed within the aperture 38 defined by the top wall 34. The light source 44 extends through the reflective body 56 and defines a central axis C. The lamp stand 52 positions the light source 44 relative to the reflective body 56 for directing the light. In one embodiment the metal halide lamp includes an arc tube (not shown) that emits light from the lamp. The location of arc tube relative to the reflective body 56 determines the output from the lighting assembly 20. In practice, the light output from the lighting assembly 20 can vary by up to 40% based on the location of the lamp stand 52. It is to be appreciated that the optimal location of the light source 44 will dictated by the type of light source 44 used with the lighting assembly 20. The light emitted from the light source 44 is reflected off of the reflective body 56 and uniformly dispersed out of the lighting assembly 20 for providing uniform illumination to an area below the lighting assembly 20. The lighting assembly 20 of the present invention is able to emit up to 93% of the light provided by the light source 44. The reflective body 56 defines a dome-shaped configuration and is secured to the housing 26.

Figure 7:
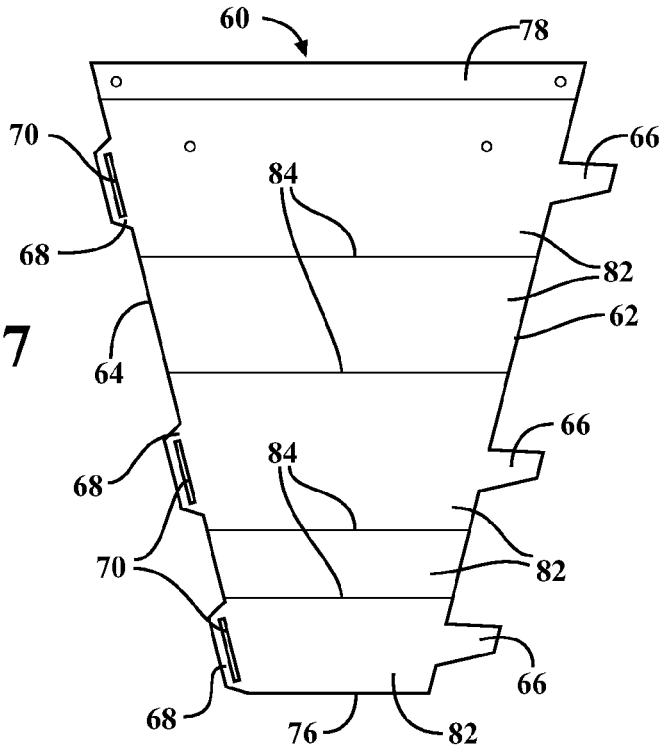
FIG. 7 is planar view of a first reflector.
Figure 9:
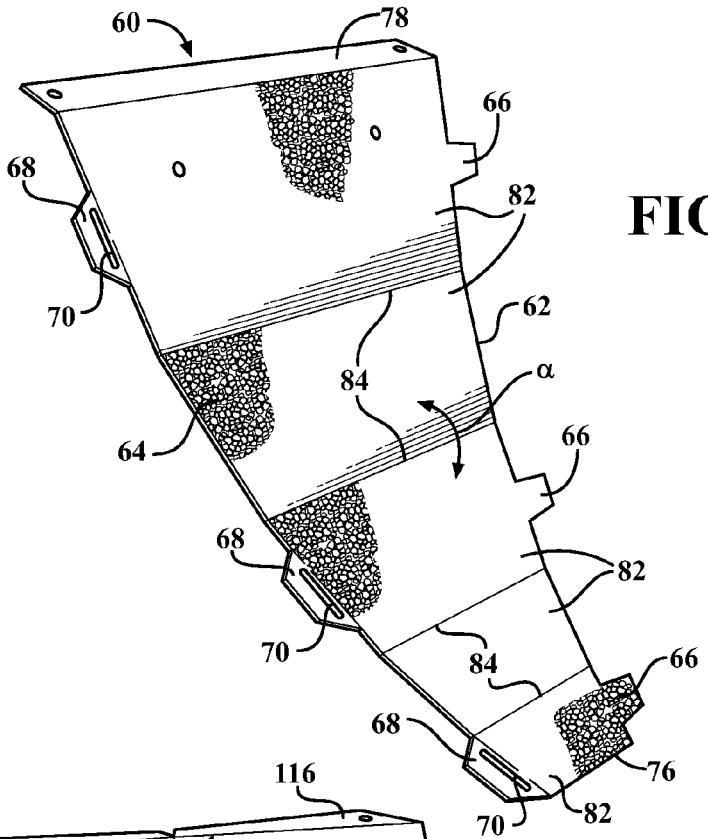
FIG. 9 is a perspective view of the first reflector.
Figure 11:
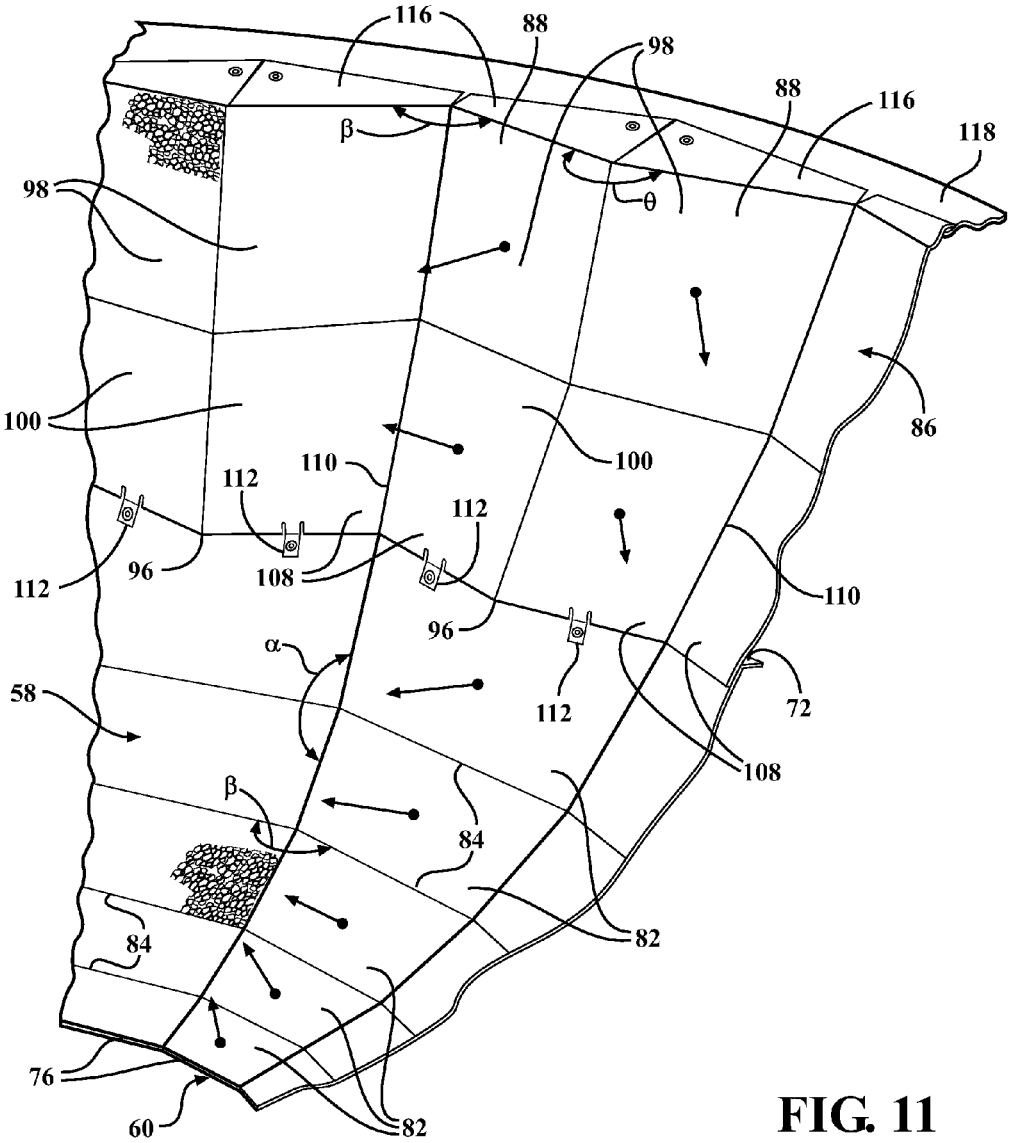
FIG. 11 is a fragmented perspective view of the reflective body.

FIG. 7 shows a first reflector 60 in a planar view prior to being formed. FIG. 9 illustrates the first reflector 60 in a perspective view after the first reflector 60 has been formed. The first reflector 60 includes a first side 62 and a second side 64. A plurality of first attachment elements 66 extend from the first side 62. The first attachment elements 66 are further defined as tabs 66. A plurality of second attachment elements 68 extend from the second side 64 and define a slot 70. The first reflector 60 is further defined as a plurality of first reflectors 60 and will be referred to in the plural form henceforth. Each slot 70 is adapted to accept one of the tabs 66 extending from the next adjacent first reflectors 60 for securing the first reflectors 60 in a lower array 58. Each of the first reflectors 60 are in an obtuse angular relationship with the next adjacent first reflectors 60. The first reflectors 60 form the lower array 58 of the reflective body 56 as best shown in FIG. 11. For illustrative purposes only, this obtuse angular relationship is illustrated as $\beta$. Typically $\beta$ is of from about 110° to about 170°, more typically from about 120° to about 150°. It is to be appreciated that other methods of attaching the first reflectors 60 together in the lower array 58 may be employed without deviating from the subject invention.

As best shown in FIG. 6, a lower ring 72 is disposed about the central axis C. The first reflectors 60 further include a first upper end 74 and a lower end 76 spaced from the first upper end 74. A first flange 78 extends from the first upper end 74 for attaching to the lower ring 72 and securing the first reflectors 60 in the lower array 58. When in the lower array 58, the lower end 76 of each of the first reflectors 60 define a hole 80, as best shown in FIG. 12, for allowing the light socket 54 and the light source 44 to pass therethrough and into the reflective body 56.

Each of the first reflectors 60 comprise a plurality of planar surfaces 82 defined by a plurality of horizontal bends 84. Each of the planar surfaces 82 are in an obtuse angular relationship with each of the next adjacent planar surfaces 82. For illustrative purposes only, this obtuse angular relationship is illustrated as a in FIG. 11. It is to be appreciated that the obtuse angular relationship a between each of the planar surfaces 82 may vary along the first reflector 60. Said differently, each of the planar surfaces 82 are at different obtuse angles relative to one another. The obtuse angles between the planar surfaces 82 progressively get steeper moving from the lower end 76 toward the first upper end 74 along each of the first reflectors 60, such that an arcuate configuration is formed, as best shown in FIG. 11. Additionally, each of the planar surfaces 82 increase in size moving from the lower end 76 toward the first upper end 74.

Referring now to FIGS. 11-13, the reflective body 56 further includes an upper array 86 of second reflectors 88 disposed about the central axis C. The second reflectors 88 are coupled to the first reflectors 60, forming the dome-shaped configuration. Each of the second reflectors 88 include a left face 90 and a right face 92 defining a reflex angle θ therebetween. Typically θ is greater than 180°, more typically of from about 181° to about 270°, even more typically from about 181° to about 220°. The reflex angle θ terminates in a vertex 96 forming a triangular protrusion extending toward the central axis C. The vertex 96 is centrally disposed on planar surface of the first reflectors 60 nearest each of the second reflectors 88. The left face 90 and the right face 92 each include an upper portion 98 and a lower portion 100 and define an obtuse angular relationship between the upper portion 98 and the lower portion 100 of each of the left 90 and right 92 faces such that the upper portion 98 is at a steeper incline than the lower portion 100. For illustrative purposes only, this obtuse angular relationship is illustrated as y in FIG. 10. Additionally, the upper array 86 defines an obtuse angular relationship between next adjacent second reflectors 88, illustrated as β as described above.

Figure 8:
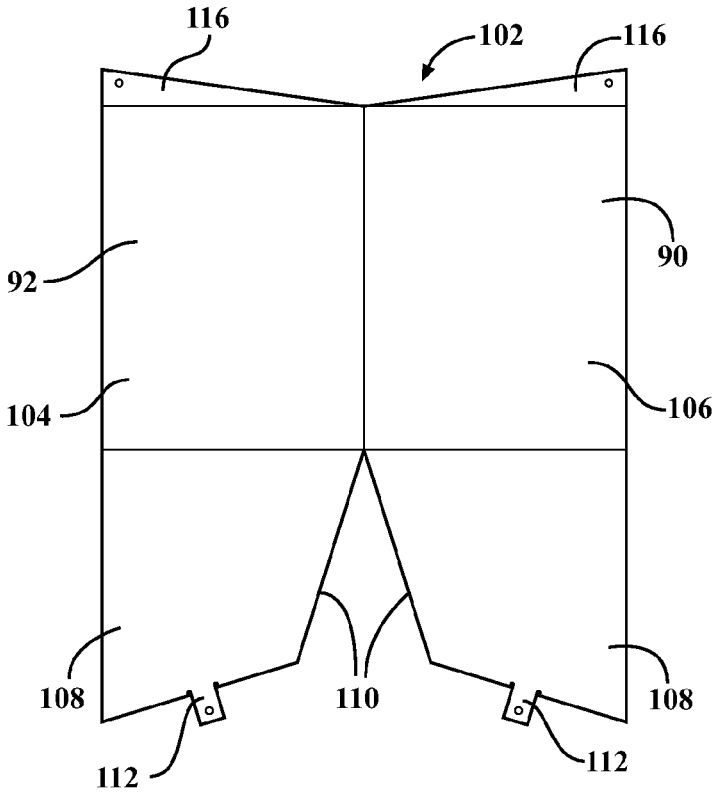
FIG. 8 is a planar view of an upper panel.
Figure 10:
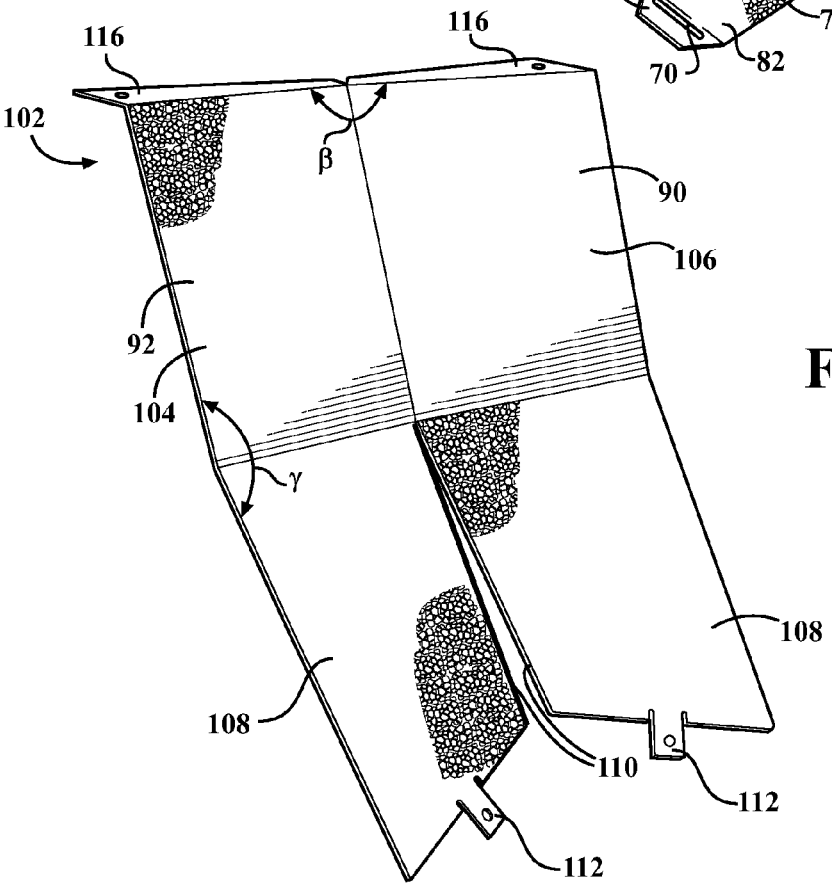
FIG. 10 is a perspective view of the upper panel.

FIG. 8 shows an upper panel 102 in a planar view prior to being formed. FIG. 10 illustrates the upper panel 102 in a perspective view after the upper panel 102 has been formed. The upper panel 102 is further defined as a plurality of upper panels 102 and will be referred to in the plural form henceforth. Each of the second reflectors 88 are formed by a pair of next adjacent upper panels 102. The upper panels 102 include a primary side 104 and a secondary side 106. The primary side 104 forms the right face 92 of one of the second reflectors 88 and the secondary side 106 forms the left face 90 of the next adjacent second reflectors 88. The upper panels 102 include the upper portion 98 of the second reflectors 88 described above. Additionally, the upper panels 102 include a pair of legs 108 extending from the upper portion 98 and define a slit 110 therebetween for allowing the upper panels 102 to bend forming the second reflectors 88. The legs 108 form the lower portion 100 of the second reflectors 88. Each of the legs 108 includes a projection 112 extending therefrom for fastening to the first reflectors 60. Each of the primary side 104 and the secondary side 106 further include a second upper end 114 each having a second flange 116 extending therefrom.

Referring now to FIGS. 6 and 11, an upper ring 118 is disposed about the central axis C and spaced from the lower ring 72. Each second flange 116 attaches to the upper ring 118 for securing the upper panels 102 in the upper array 86. In one embodiment, the slit 110 is aligned with the second side 64 of one of first reflectors 60 and the first side 62 of the next adjacent first reflectors 60, such that one of the legs 108 of the upper panels 102 is coupled to one of the first reflectors 60 and the other one of the legs 108 is coupled to the next adjacent first reflectors 60.

Figure 14:
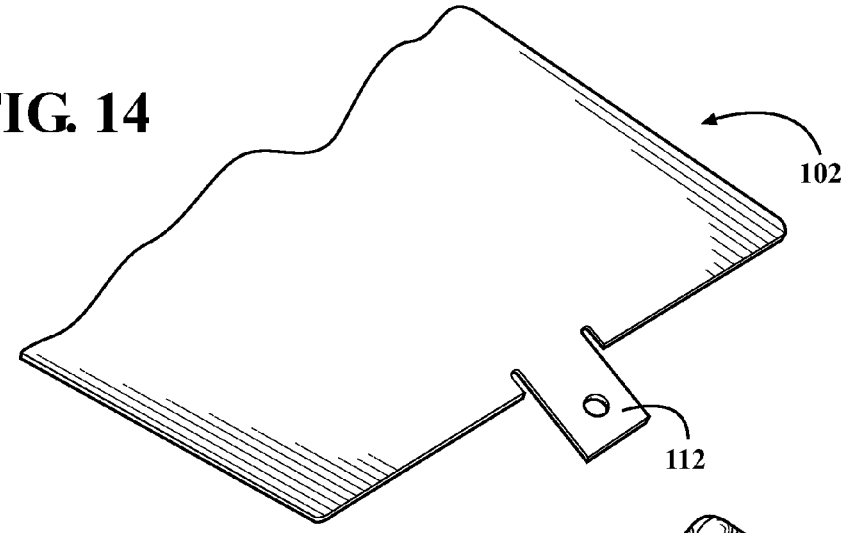
FIG. 14 is a fragmented perspective view of the second reflector illustrating a smooth surface finish.
Figure 15:
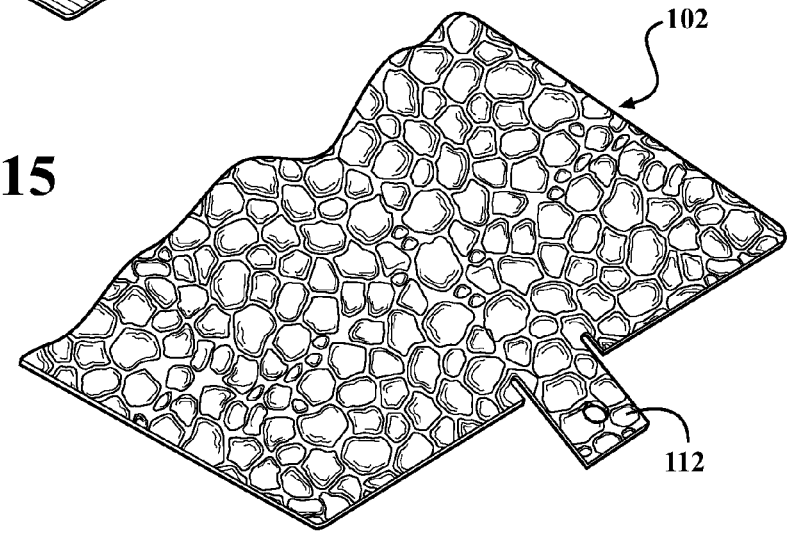
FIG. 15 is a fragmented perspective view of the second reflector illustrating a first surface treatment.
Figure 16:
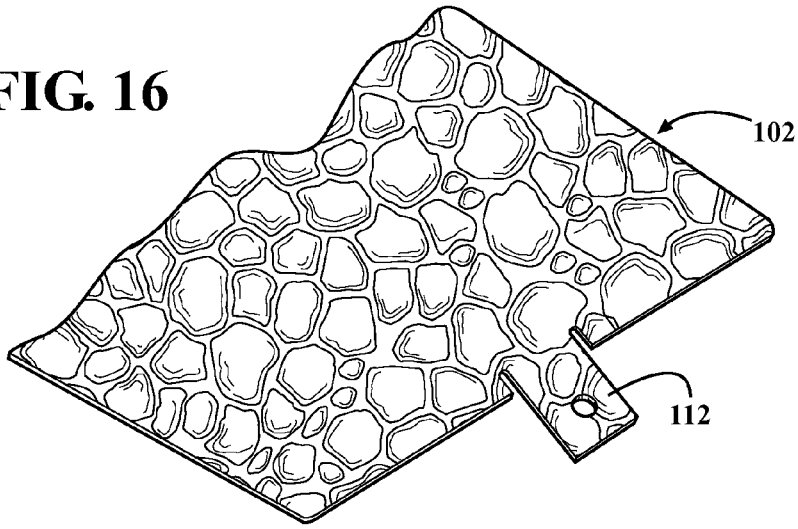
FIG. 16 is a fragmented perspective view of the second reflector illustrating a second surface treatment.

In one embodiment the first 60 and second 88 reflectors are typically fabricated from Micro-4® aluminum, manufactured by Alanod®. A variety of finishing treatments may be applied to the surface of the first 60 and second 88 reflectors. Varying sized dimples may be applied to the surface to achieve the desired light output of the lighting assembly 20. This dimpling is commonly referred to as hammer-tone finishing as best illustrated in FIGS. 15 and 16. Typically the dimpling has a diameter of ½ inch or less, more typically ⅜ inch or less, even more typically ¼ inch or less. Alternatively, the surface can be left smooth resulting in a minor-like finish as shown in FIG. 14. The first 60 and second 88 reflectors may have the same type of finishing treatments applied or each may have a different type of finishing treatments depending on the application of the lighting assembly 20. It is to be appreciated that any other appropriate finishing treatments may be applied to the first 60 and second 88 reflectors without deviating from the subject invention.

Figure 17:
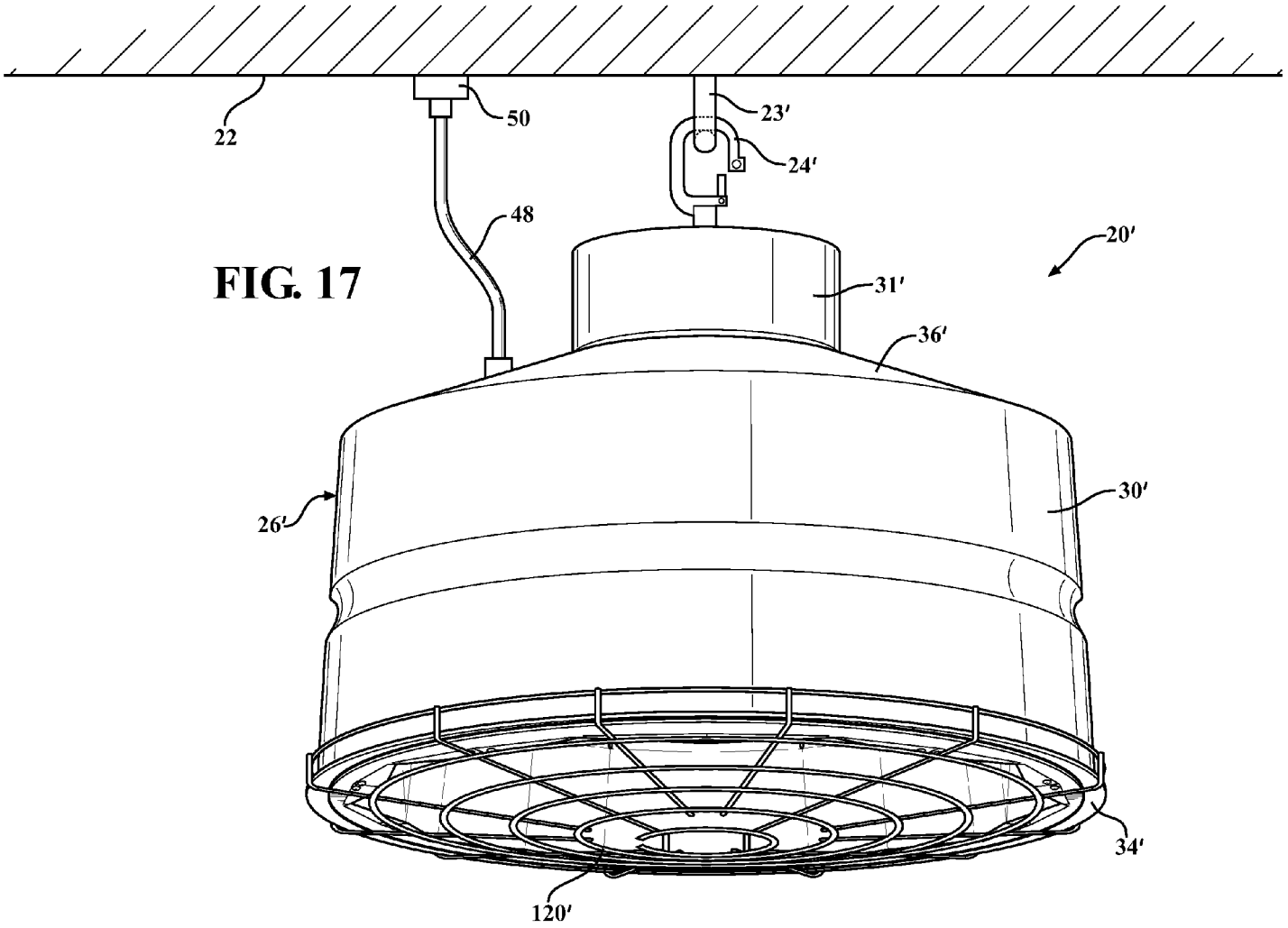
FIG. 17 is a perspective view of a lighting assembly of another embodiment.
Figure 18:
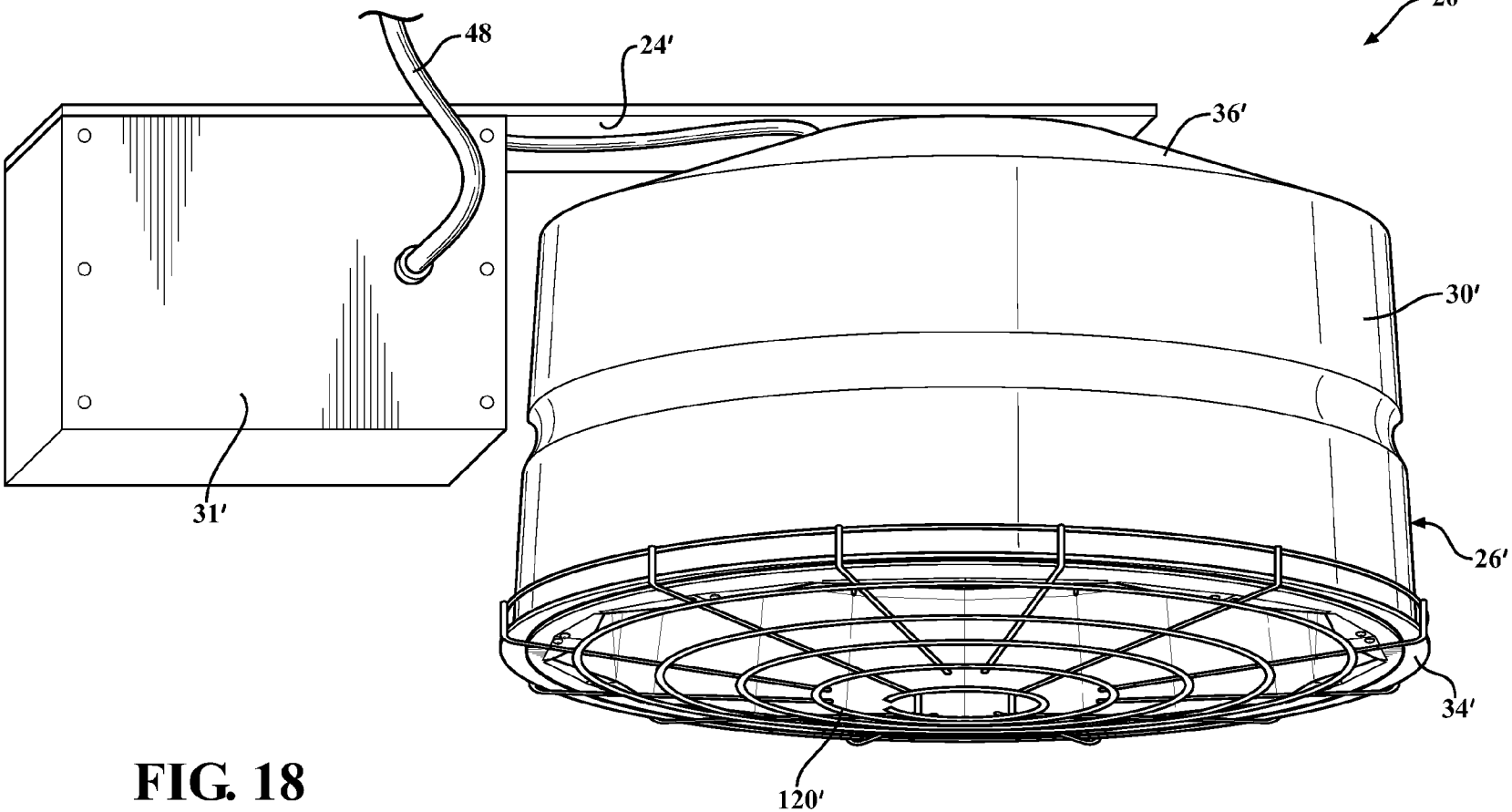
FIG. 18 is a perspective view of a lighting assembly of another embodiment utilizing a bracket and a ballast coupled to the bracket.

In alternative embodiments, the lighting assembly, may be further defined as direct-light assemblies, which are shown in FIGS. 17 and 18. In other words, the lighting assembly may be directed toward the floor below the lighting assembly, rather than toward the ceiling 22, as discussed above. As such, like or corresponding parts from one embodiment are accompanied by prime symbols in subsequent embodiments to indicate modification to those like or corresponding parts between the various embodiments. The housing 26 may define alternative configurations throughout the various embodiments. For example, the housing 26 may define a rectangular shape, a triangular shape, a hexagonal shape, a polygonal shape, etc., without deviating from the scope of the present disclosure.

With reference to FIG. 17, the lighting assembly 20' may include a housing 26' comprising a continuous side wall 30' and an end wall 36' coupled thereto. A casing 31' may extend from the end wall 36' and define a secondary cavity (not shown). In other words, the casing 31' is generally empty and may be configured to receive other components, such as the ballast 46 or a dimmer assembly. The ballast 46 may be disposed within the casing 31' for concealing the ballast 46 and making the lighting assembly 20' more aesthetically pleasing. An attachment mechanism 24' may be coupled to the lighting assembly 20' for coupling to the ceiling 22. In FIG. 17, the attachment mechanism 24' is coupled to the casing 31'. The attachment mechanism 24' may be a hook configured to mate with a complementary mechanism 23' extending from the ceiling 22 for coupling the lighting assembly 20' to the ceiling 22. The complementary mechanism 23' may be another hook, an eyelet, or any other device that will mate with the attachment mechanism 24' for coupling the lighting assembly 20' to the ceiling 22. In this embodiment, the power cable 48 may extend from the end wall 36' for coupling the lighting assembly 20' to the electric power source 50. Alternatively, the power cable 48 may extend from the casing 31' without deviating from the scope of the present disclosure.

In another embodiment, as shown in FIG. 18, the lighting assembly 20' may include the housing 26'. The casing 31' for enclosing the ballast 46 may be disposed outside and spaced from the housing 26'. In other words, the casing 31' is not in contact with the housing 26'. The attachment mechanism 24' may couple the casing 31' to the housing 26', specifically, the attachment mechanism 24' couples the end wall 36' of the housing 26' to the casing 31'. The attachment mechanism 24' may be coupled to the ceiling 22 utilizing and appropriate method, such as bolts or screws. In certain embodiments, the attachment mechanism 24' may be coupled to the ceiling 22 via cables disposed between the attachment mechanism 24' and the ceiling 22. The attachment mechanism 24' may be further defined as a flat plate. However, it is to be appreciated that the attachment mechanism 24' may define other configurations without deviating from the subject invention. The power cable 48 typically extends from the ballast 46 and through the casing 31' for coupling the lighting assembly 20' to the electrical source 50.

Figure 19:
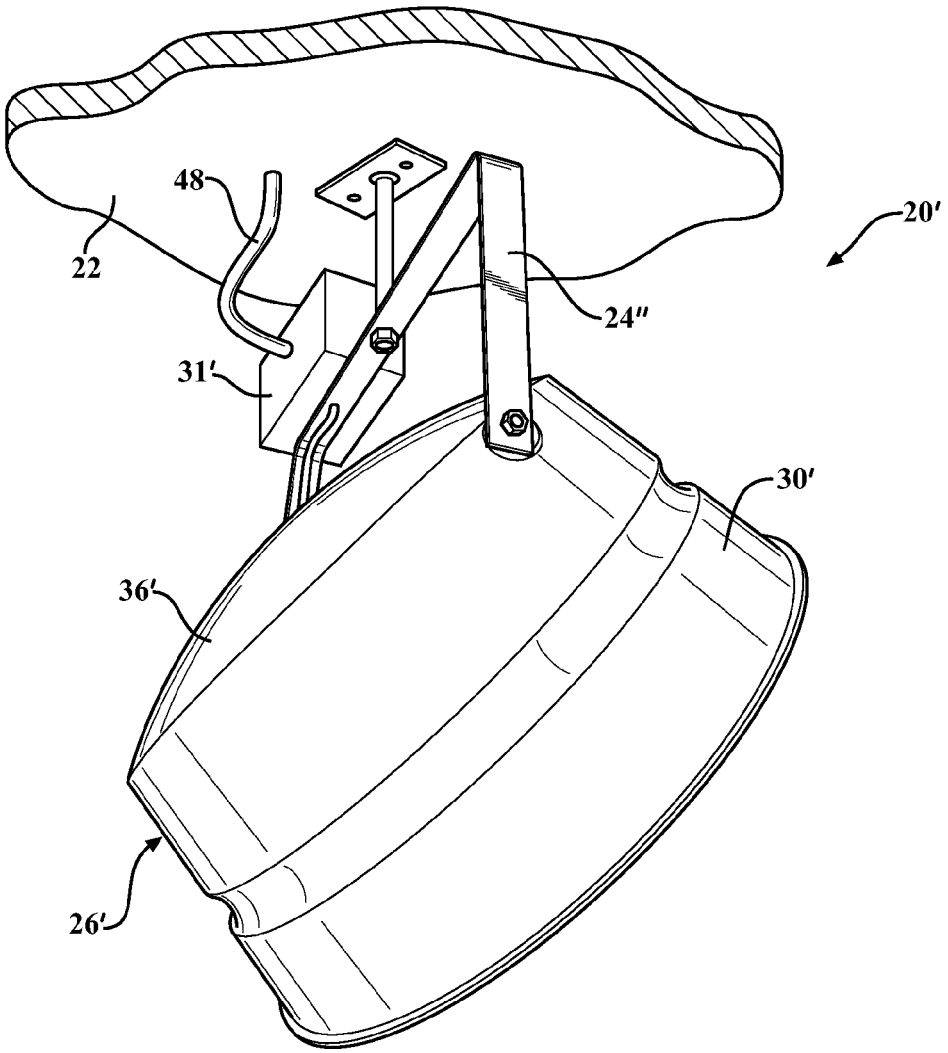
FIG. 19 is perspective of a lighting assembly of another embodiment utilizing a bracket and a ballast coupled to the bracket

With reference to FIG. 19, another embodiment of the lighting assembly 20' is shown. Again, the lighting assembly 20' includes the housing 26' having the continuous side wall 30' with the end wall 36' coupled thereto. The lighting assembly 20' may also include the attachment mechanism 24" configured to allow the housing 26' to move in various directions. Specifically, the attachment mechanism 24" includes a generally U-shaped portion which couples to the continuous side wall 30'. The housing 26' is pivotably coupled to the attachment mechanism 24" such that the housing 26' may pivot within the U-shaped portion between various angles relative to the attachment mechanism 24" for positioning the lighting assembly 20'. The attachment mechanism 24" further includes a connection rod disposed between the U-shaped portion and the ceiling 22 for coupling the lighting assembly 20' to the ceiling 22 and allowing the housing 30' to pivot relative to the ceiling 22 and allow for additional positioning of the lighting assembly 20'. The present embodiment is advantageous because the lighting assembly 20' may be moved to an almost infinite number of positions and allow for ideal lighting conditions for a given event or need. Additionally, because the housing 30' may pivot within the U-shaped portion, the lighting assembly 20' may function as both an indirect-light assembly and as a direct-light assembly. The casing 31' may be coupled to the attachment mechanism 24" and is spaced from the housing 26' for enclosing the ballast 46 therein. This type of configuration is typically referred to as a remote ballast in the art. The remote ballast may be coupled to the lighting assembly 20, 20' as illustrated, or may be spaced from the lighting assembly 20, 20'. The remote ballast may also be spaced from the lighting assembly of from about a few inches to about 33 feet from the lighting assembly 20, 20'. In certain embodiments, the remote ballast may be spaced up to about 300 feet from the lighting assembly 20, 20'. It is to be appreciated that the primary difference of the various embodiments illustrated in FIGS. 17-19 is the attachment mechanism 24 employed.

Although coupling to the ceiling 22 is referenced throughout the present specification, it is to be appreciated that the lighting assembly 20, 20', specifically the mounting of the lighting assembly 20, 20', is not so limited. The lighting assembly 20, 20' may also be coupled to a wall, a beam, a pole, or any other mounting structure without deviating from the scope of the present disclosure.

Referring to FIGS. 17 and 18, the screen 120' may be configured to fit over the housing 26'. In other words, the screen 120' may extend past the top wall 34' and be retained over the reflective body 56 though a snap fit with the housing 26', such that a portion of the screen 120' abuts the side wall 30'. Again, any appropriate fastener may also be used to couple the screen 120' to the housing 26', in addition to or in place of the snap fit. Typically, the screen 120, 120' must be removed to access the light source 44. However, with reference to FIGS. 20 and 21, the screen 120" may further include a door 122". The door 122" allows for access to the light source 44 and the reflective body 56 without having to remove the screen 120" from the housing 26'. It is to be appreciated that any embodiment of the screen 120, 120', 120" may include the door 122" without deviating from the scope of the present invention. The various embodiments of the screen 120, 120', and 120", as well as variations thereof, may be utilized with any lighting assembly 20, 20' described above including alternative embodiments not specifically described above.

Figure 20:
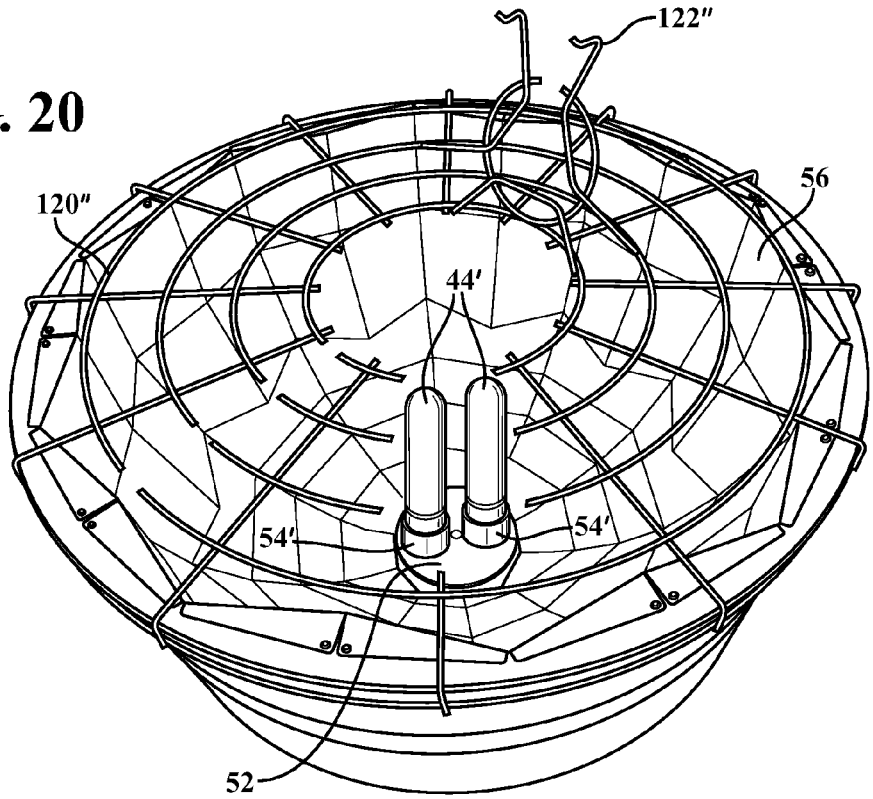
FIG. 20 is a partially broken perspective view of a lighting assembly having a pair of sockets for accepting a pair of light sources.
Figure 21:
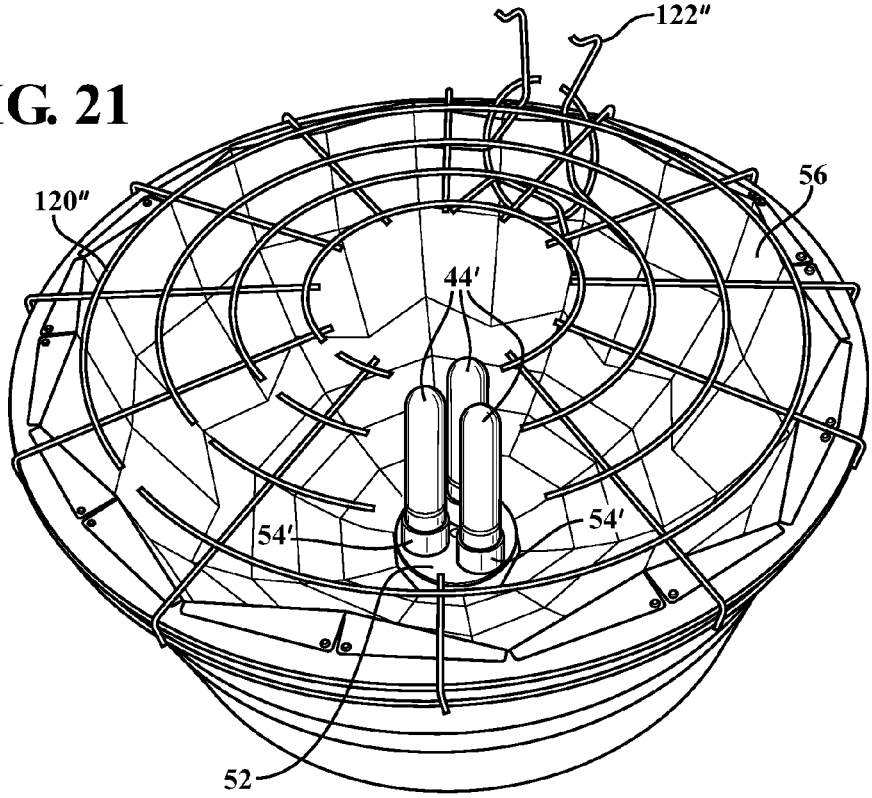
FIG. 21 is a partially broken perspective view of another embodiment of the lighting assembly having three sockets for accepting three light sources.

With continued reference to FIGS. 20 and 21, the lamp stand 52 may include a plurality of sockets 54'. It is to be appreciated that the number of sockets 54' coupled to the lamp stand 52 is not limited and may include any number of sockets 54' without deviating from the scope of the present disclosure. It is also to be appreciated that the lamp stand 52 may be further defined as a plurality of lamp stands 52 and that any number of sockets 54' may be coupled to any number of lamp stands 52 without deviating from the scope of the present disclosure. As such, the light source 44 may be further defined as a plurality of light sources 44'. Typically, the number of light sources 44' required for the lighting assembly 20, 20' dictates the number of sockets 54' coupled to the lamp stand 52. However, it is to be appreciated that more sockets 54' may be coupled to the lamp stand 52 than the number of light sources 44' required for a particular lighting assembly 20, 20' without deviating from the scope of the present disclosure.

In certain embodiments, the lighting assembly 20, 20' may further include a dimming apparatus (not shown) coupled to the electrical system 42 for allowing each light source 44 to be dimmed. The dimming apparatus is well known to those in the lighting arts may be incorporated into the lighting assembly 20, 20' for dimming the light output from the light source 44 within the lighting assembly 20, 20'. Each light source 44 may be dimmed of from about 100% light output to about 1% light output, more typically from about 100% light output to about 25% light output, and most typically from about 100% light output to about 50% light output. Dimming is desirable because it will help extend the life of each light source 44 as well as save energy and costs associated therewith. Additionally, dimming each light source 44 allows the lighting assembly 20, 20' to remain on in a low output setting for extended periods of time and only consume a relatively small amount of electricity. Remaining on at the low output setting is advantageous because it allows the lighting assembly 20, 20' to be utilized instantly when it is needed and eliminates extended "warm-up" periods before the lighting assembly 20, 20' is outputting light at a usable level. These "warm-up" periods are a common downfall of lighting assemblies presently available on the market and may take up to ten minutes or more when the lighting assembly is switched to an on setting.

Each light source 44 may be further defined as high-efficiency light sources. Suitable examples of high-efficiency light sources are commercially available under the trade name T-9 lamps and T-12 lamps from Philips Lighting U.S. of Somerset, N.J.

Combining the subject housing 26, 26' and reflective body 56 with these high-efficiency light sources 44' increases the light output of each lighting assembly 20, 20'. Specifically, the high-efficiency light sources 44' combined with the subject reflective body 56 outputs up to 40% more light than a standard metal-halide light source. For example, the standard metal-halide light source utilized in this type of application will consume about 1000 W, while an exemplary lighting assembly 20, 20' of the present disclosure may utilize two 315 W high-efficiency light sources 44, in sum consuming approximately 630 W. Obviously, less Watts are consumed by the lighting assembly 20, 20' of the present disclosure. However, up to 40% more light is output from the lighting assembly 20, 20' of the present disclosure, while using less energy.

As one example of the improvement of the subject invention and without intending to be limiting, in a recent analysis significant cost savings were realized. Without accounting for the additional light output and merely focusing on the energy savings, approximately 370 W of energy may be saved per unit, i.e. 1000 W−630 W=370 W. Electricity consumption is typically measured in kilowatt hours. Simply put, a kilowatt hour (kWh) is a measurement of how many kilowatts of energy are consumed in one hour. The analysis examined how much cost savings will be realized per lighting assembly in a year. Assuming each lighting assembly 20, 20' will be turned on every day (365 days) for 18 hours per day, each lighting assembly 20, 20' will be on for about 6570 hours per year. Since there are 1000 W in 1 kW, each lighting assembly 20, 20' will save about 0.370 kW over lighting assemblies generally known in the art. Therefore, each lighting assembly 20, 20' of the present disclosure will save about 2431 kWh over a year of use. Currently, electricity is billed at about fourteen (14) cents per kWh. As such, each lighting assembly will save about $340 per year. If a facility utilizes 1000 lighting assemblies 20, 20', that facility will save over $340,000 per year in energy costs. Additionally, as a result of the additional light output, the facility may reduce the total number of lighting assemblies utilized, further reducing the energy costs incurred by the facility.

The present invention has been described in an illustrative manner, and it is to be understood that the terminology which as been used in intended to be in the nature of words of description rather than of limitation. Obviously, many modifications and variations of the present invention are possible in light of the above teachings. The invention may be practiced otherwise than as specifically described within the scope of the appended claims.

What is claimed is:

1. A lighting assembly for illuminating an area, said assembly comprising:

a housing;

at least one light socket disposed within said housing for receiving at least one light source to emit light therefrom; and a reflective body disposed about said light socket for uniformly disbursing the light emitted from the light source out of the lighting assembly, wherein said reflective body comprises;

a lower array of first reflectors disposed about a central axis having next adjacent first reflectors in an obtuse angular relationship with one another, an upper array of second reflectors disposed about said central axis; each of said second reflectors comprising a left face and a right face, and said upper array comprising a plurality of obtuse angles defined by next adjacent second reflectors and a plurality of reflex angles defined by said left face and said right face of said second reflectors.

2. The lighting assembly as set forth in claim 1 wherein said first reflectors of said reflective body comprise a plurality of planar surfaces defined by discrete horizontal bends with next adjacent planar surfaces in obtuse angular relationships with one another.

3. The lighting assembly as set forth in claim 2 wherein said first reflectors of said reflective body further include a lower end and said planar surfaces progressively increase in size moving away from said lower end and approaching said second reflectors of said reflective body.

4. The lighting assembly as set forth in claim 3 wherein said reflex angles defined by said left face and said right face of said first reflectors of said reflective body terminate in a vertex forming a triangular protrusion extending away from said second reflectors of said reflective body with said vertex being centrally positioned on said planar surfaces of said first reflectors nearest said second reflectors.

5. The lighting assembly as set forth in claim 1 wherein said first reflectors of said reflective body form an arcute configuration for transitioning said first reflectors into said second reflectors.

6. The lighting assembly as set forth in claim 1 wherein said left and said right faces of said second reflectors of said reflective body further include an upper portion and a lower portion, wherein said upper portion and said lower portion are disposed in an obtuse angular relationship to one another.

7. The lighting assembly as set forth in claim 6 wherein said upper portion of said second reflectors is at a steeper incline than said lower portion of said second reflectors relative to said central axis.

8. The lighting assembly as set forth in claim 1 wherein said upper and said lower arrays of said reflectors form a dome-shaped structure.

9. The lighting assembly as set forth in claim 8 wherein said first reflectors of said reflective body are coupled to a lower ring and said second reflectors of said reflective body are coupled to an upper ring for supporting said first and second reflectors in said dome-shaped structure.

10. The lighting assembly as set forth in claim 1 wherein each of said first reflectors of said reflective body include a first side presenting a plurality of first attachment elements and said first reflectors of said reflective body further include a second side spaced from said first side and presenting a plurality of second attachment elements.

11. The lighting assembly as set forth in claim 10 wherein said first attachment elements are further defined as tabs extending from said first side and said second attachment elements define a slot therein for accepting said tabs of next adjacent said first reflectors for coupling next adjacent first reflectors to one another thereby forming said lower array of said first reflectors.

12. The lighting assembly as set forth in claim 1 wherein said housing defines a cavity and an aperture for accepting said reflective body within said lighting assembly.

13. The lighting assembly as set forth in claim 12 wherein said ballast is disposed within said cavity of said housing.

14. The lighting assembly as set forth in claim 13 wherein said housing includes a plurality of vents for ventilating said cavity and cooling said ballast disposed within said cavity.

15. The lighting assembly as set forth in claim 12 wherein said housing further includes an exterior spaced from said cavity with said ballast coupled to said exterior of said housing.

16. The lighting assembly as set forth in claim 1, wherein said at least one light socket is a dimmable for dimming the light source.

17. The lighting assembly as set forth in claim 1 wherein said at least one light socket is further defined as a plurality of light sockets.

18. The lighting assembly as set forth in claim 1 further including at least one lamp stand for positioning said light socket within said reflective body.

19. A lighting assembly comprising in combination:

an electrical assembly including a light socket for receiving at least one light source to emit light;

a housing enclosing said electrical assembly; and a reflective body comprising a lower array of first reflectors disposed about a central axis with next adjacent first reflectors in an obtuse angular relationship with one another and an upper array of second reflectors disposed about said central axis and defining a plurality of obtuse angles between next adjacent second reflectors, each of said second reflectors including a left face and a right face defining a plurality of reflex angles therebetween said reflective body having a dome-shaped structure disposed about said light socket for uniformly distributing light emitted from the light source; and said reflective body directing said light out of said dome-shaped structure for casting the light to an area below said lighting assembly.

* * * * *